US008998234B2

(12) United States Patent
Motozu et al.

(10) Patent No.: US 8,998,234 B2
(45) Date of Patent: Apr. 7, 2015

(54) CONSTRUCTION MACHINE

(75) Inventors: Makoto Motozu, Moriyama (JP); Teruo Irino, Konan (JP); Kouhei Urase, Konan (JP); Yuuki Umizaki, Koka (JP); Toshihiro Sako, Koka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/007,148

(22) PCT Filed: Jul. 10, 2012

(86) PCT No.: PCT/JP2012/067553

§ 371 (c)(1),
(2), (4) Date: Sep. 24, 2013

(87) PCT Pub. No.: WO2013/021768

PCT Pub. Date: Feb. 14, 2013

(65) Prior Publication Data

US 2014/0017054 A1 Jan. 16, 2014

(30) Foreign Application Priority Data

Aug. 9, 2011 (JP) ..... 2011-173933

(51) Int. Cl.

| | |
|---|---|
| ***B62K 21/02*** | (2006.01) |
| ***E02F 9/08*** | (2006.01) |
| ***E02F 3/32*** | (2006.01) |
| ***E02F 9/12*** | (2006.01) |

(52) U.S. Cl.

CPC ..... *E02F 9/0883* (2013.01); *E02F 3/32* (2013.01); *E02F 9/08* (2013.01); *E02F 9/12* (2013.01); *E02F 3/325* (2013.01); *E02F 9/0808* (2013.01)

(58) Field of Classification Search

USPC ..... 180/6.64, 6.6, 6.58; 280/830, 831

See application file for complete search history.

(56) References Cited

U.S. PATENT DOCUMENTS

2012/0067660 A1* 3/2012 Kashu et al. ..... 180/296

FOREIGN PATENT DOCUMENTS

| | | | |
|---|---|---|---|
| JP | 05-72549 | U | 10/1993 |
| JP | 09-151483 | A | 6/1997 |
| JP | 2001-059237 | A | 3/2001 |
| JP | 2001-288778 | A | 10/2001 |
| JP | 2002-061224 | A | 2/2002 |
| JP | 2003-064724 | A | 3/2003 |
| JP | 2005-03040 | A | 3/2005 |
| JP | 2008-183967 | A | 8/2008 |

* cited by examiner

*Primary Examiner* — Joseph Rocca
*Assistant Examiner* — Marlon Arce
(74) *Attorney, Agent, or Firm* — Mattingly & Malur, PC

(57) ABSTRACT

On a revolving frame (5), an operating oil tank (15) located on the front side of an engine (8) is provided, and a fuel tank (16) located on the front side of the operating oil tank (15) is arranged. A mounting member (17) is provided on the lower side of the fuel tank (16) across a part of a swing cylinder (14). Between the operating oil tank (15) and the mounting member (17), a vertical restraining element (20) for restraining the fuel tank (16) in a front-rear direction and a vertical direction and a lateral restraining element (25) for restraining the fuel tank (16) in a left-right direction are detachably provided. Therefore, the fuel tank (16) can be restrained in two directions, that is, in the horizontal direction and the vertical direction.

6 Claims, 9 Drawing Sheets

CONSTRUCTION MACHINE

TECHNICAL FIELD

The present invention relates to a construction machine such as a hydraulic excavator and particularly to a construction machine provided with a fuel tank on a revolving frame.

BACKGROUND ART

In general, a hydraulic excavator which is a typical example of a construction machine is largely constituted by a lower traveling structure, an upper revolving structure rotatably mounted on the lower traveling structure, and a working mechanism provided capable of moving upward/downward on the front side of the upper revolving structure.

The upper revolving structure is largely constituted by a revolving frame, an operator's seat provided on the revolving frame and on which an operator is seated, an engine located on the rear side of the operator's seat and mounted on the revolving frame, a hydraulic pump provided on the engine, an operating oil tank located on the right side of the operator's seat and provided on the revolving frame and storing an operating oil to be supplied to the hydraulic pump, and a fuel tank provided on the revolving frame and storing a fuel to be supplied to the engine.

Here, as a hydraulic excavator suitably used for an excavating work of a gutter and the like, a swing-type hydraulic excavator having a working mechanism swingably in the left-right direction with respect to the upper revolving structure can be cited. In this swing-type hydraulic excavator, a swing post located on the front side of the revolving frame constituting the upper revolving structure and made to swing in the left-right direction by a swing cylinder is provided, and the working mechanism is mounted on the swing post, capable of moving upward/downward (Patent Document 1).

In such swing-type hydraulic excavators, the operating oil tank and the fuel tank are arranged above the swing cylinder adjacently in the front-rear direction in order to effectively use an installation space for equipments in the upper revolving structure. Thus, in a conventional art, such a hydraulic excavator is known that, when a maintenance work for the swing cylinder is to be performed and the like, the fuel tank is constructed to be fixed to the revolving frame by using a fixing belt in order to mount/remove the fuel tank to/from the revolving frame easily (Patent Document 2, Patent Document 3).

On the other hand, as another conventional art, a structure for fixing the fuel tank by arranging two fixing belts on an outer peripheral surface of the fuel tank in a vertical direction or in the left-right direction in parallel is proposed (Patent Document 4, Patent Document 5). Moreover, a structure for fixing the fuel tank by crossing two fixing belts with each other in a cross-state on the outer peripheral surface of the fuel tank is proposed (Patent Document 6).

PRIOR ART DOCUMENT

Patent Document

Patent Document 1: Japanese Patent Laid-Open No. 2005-83040 A

Patent Document 2: Japanese Patent Laid-Open No. 2002-61224 A

Patent Document 3: Japanese Patent Laid-Open No. Hei 9-151483 A

Patent Document 4: Japanese Patent Laid-Open No. 2001-288778 A

Patent Document 5: Japanese Utility Model Laid-Open No. Hei 5-72549 A

Patent Document 6: Japanese Patent Laid-Open No. 2008-183967 A

SUMMARY OF THE INVENTION

In the mounting structures of the fuel tank according to the above-described Patent Document 2 to Patent Document 5, the fuel tank is fixed by using one fixing belt or two fixing belts arranged in parallel. Thus, the fuel tank can be restrained only in either one of a horizontal direction or a perpendicular direction (vertical direction), and it has a problem that the fuel tank might be displaced by vibration of the hydraulic excavator.

On the other hand, as in the above-described Patent Document 6, if the fuel tank is restrained in the horizontal direction and the perpendicular direction by crossing the two fixing belts in a cross-state on the outer peripheral surface of the fuel tank, the fuel tank can be firmly fixed. However, with this conventional art, a dedicated mounting base is required for fixing the fuel tank, and it has a problem that the number of components increases and a manufacturing cost rises.

In view of the above-described problems of the conventional art, it is an object of the present invention to provide a construction machine which can firmly fix the fuel tank without incurring an increase in the number of components.

(1) A construction machine according the present invention comprises a lower traveling structure, an upper revolving structure rotatably mounted on the lower traveling structure, a working mechanism provided on the front side of the upper revolving structure capable of moving upward/downward, and a counterweight provided on the rear side of the upper revolving structure in order to keep balance with the working mechanism, wherein the upper revolving structure is provided with: a revolving frame forming a support structural body and on which a supporting bracket is provided on a front end; an engine located on the front side of the counterweight and mounted on the revolving frame; a swing post provided on the supporting bracket of the revolving frame and supporting the working mechanism swingably in the left-right direction; a swing cylinder provided between the swing post and the revolving frame and swinging the swing post in the left-right direction; an operating oil tank located in the vicinity of the swing cylinder and on the front side of the engine and provided on the revolving frame and storing an operating oil to be supplied to a hydraulic actuator; and a fuel tank located on the front side of the operating oil tank and provided on the revolving frame and storing a fuel to be supplied to the engine.

A feature of the configuration adopted by the present invention is that, a mounting member is provided on the revolving frame across apart of the swing cylinder and located on the lower side of the fuel tank; a vertical restraining element for restraining the fuel tank in the front-rear direction and the vertical direction is detachably provided between an upper-part position of the operating oil tank and the mounting member; and a lateral restraining element for restraining the fuel tank in the left-right direction is detachably provided between a side surface portion on the outside in the left-right direction of the operating oil tank and the mounting member.

With this arrangement, since the fuel tank is reliably fixed by the vertical restraining element and the lateral restraining element in the two directions (or more specifically, in the three axial directions), that is, in the horizontal direction (front-rear direction and left-right direction) and the perpendicular direction (vertical direction), dislocation of the fuel tank with respect to the revolving frame caused by vibration during traveling or working of the construction machine can be suppressed. As a result, dislocation of the fuel tank and contact with the peripheral mounted devices can be prevented. Therefore, a clearance between the fuel tank and the peripheral mounted equipment can be set smaller, and a capacity of the fuel tank can be sufficiently ensured by that portion.

Moreover, since the vertical restraining element and the lateral restraining element can be mounted by using the mounting member across a part of the swing cylinder and the operating oil tank, it is not necessary to individually mount the vertical restraining element and the lateral restraining element by using the respective dedicated fixture or the like. As a result, an increase in the number of components can be suppressed, and contribution can be also made to reduce a manufacturing cost. In addition, by detachably attaching the vertical restraining element and the lateral restraining element to the mounting member or the operating oil tank, the fuel tank can be easily made detachable when the fuel tank is to be replaced or during a maintenance work of the swing cylinder and the like.

(2) According to the present invention, the upper revolving structure is configured such that the revolving frame is formed of a bottom plate and left and right vertical plates; the supporting bracket supporting the swing post is provided on the front ends of the left and right vertical plates; the swing cylinder is provided by being located outside in the left-right direction from one vertical plate of the vertical plates; and the operating oil tank and the fuel tank are arranged in the front-rear direction along the swing cylinder. With this arrangement, the operating oil tank and the fuel tank can be mounted on the revolving frame by using a space around the swing cylinder.

(3) According to the present invention, an upper surface of the fuel tank is formed lower than an upper surface of the operating oil tank; the vertical restraining element is constituted by a connecting member located on the upper side from the upper surface of the fuel tank and mounted on the operating oil tank and a belt member having the upper end side connected to the connecting member and the lower end side mounted on the mounting member and brought into contact with a front surface of the fuel tank; and the lateral restraining element is constituted by a belt member having the front end side mounted on the mounting member and the rear end side mounted on a side surface portion outside the operating oil tank and brought into contact with a side surface portion outside in the left-right direction of the fuel tank.

With this arrangement, since the connecting member constituting the vertical restraining element is fixed to the operating oil tank in a state located on the upper side from the upper surface of the fuel tank, movement of the fuel tank in the vertical direction can be regulated.

(4) According to the present invention, the connecting member mounted on the operating oil tank is configured to be provided either at an upper-part position on the front surface or at a front-part position on the upper surface of the operating oil tank. With this arrangement, by mounting the connecting member on the operating oil tank, the connecting member can be brought into contact with the upper surface of the fuel tank, and movement of the fuel tank in the vertical direction can be regulated.

(5) According to the present invention, the fuel tank is configured such that its bottom surface is formed having a stepped bottom surface shape having a deep bottom portion outside and a shallow bottom portion inside in the left-right direction; the mounting member is configured having an inverted L-shape formed of a vertical plate portion and a lateral plate portion connected to an upper end of the vertical plate portion in the left-right direction so as to surround the swing cylinder; and the shallow bottom portion of the fuel tank is placed on the lateral plate portion of the mounting member, and the lower end side of the vertical restraining element and the front end side of the lateral restraining element are mounted on the vertical plate portion.

With this arrangement, since the shallow bottom portion of the fuel tank is arranged on the upper side of the swing cylinder through the mounting member, the capacity of the fuel tank can be increased by using an upper space of the swing cylinder. Moreover, since the lower end side of the vertical restraining element and the front end side of the lateral restraining element are fixed to the same mounting member, the number of components can be reduced, and a manufacturing cost can be kept low.

(6) According to the present invention, the upper revolving structure is formed as a rear small-revolving type defining a distance between a revolving center with respect to the lower traveling structure and the counterweight as a revolving radius; and the fuel tank is formed having an arc shape so that the side surface portion on the outside is contained in the revolving radius. With this arrangement, when the upper revolving structure makes a revolving operation, the side surface on the outside of the fuel tank does not protrude from the revolving radius of the upper revolving structure, and safety of the revolving operation can be improved.

MODE FOR CARRYING OUT THE INVENTION

Figure 1:
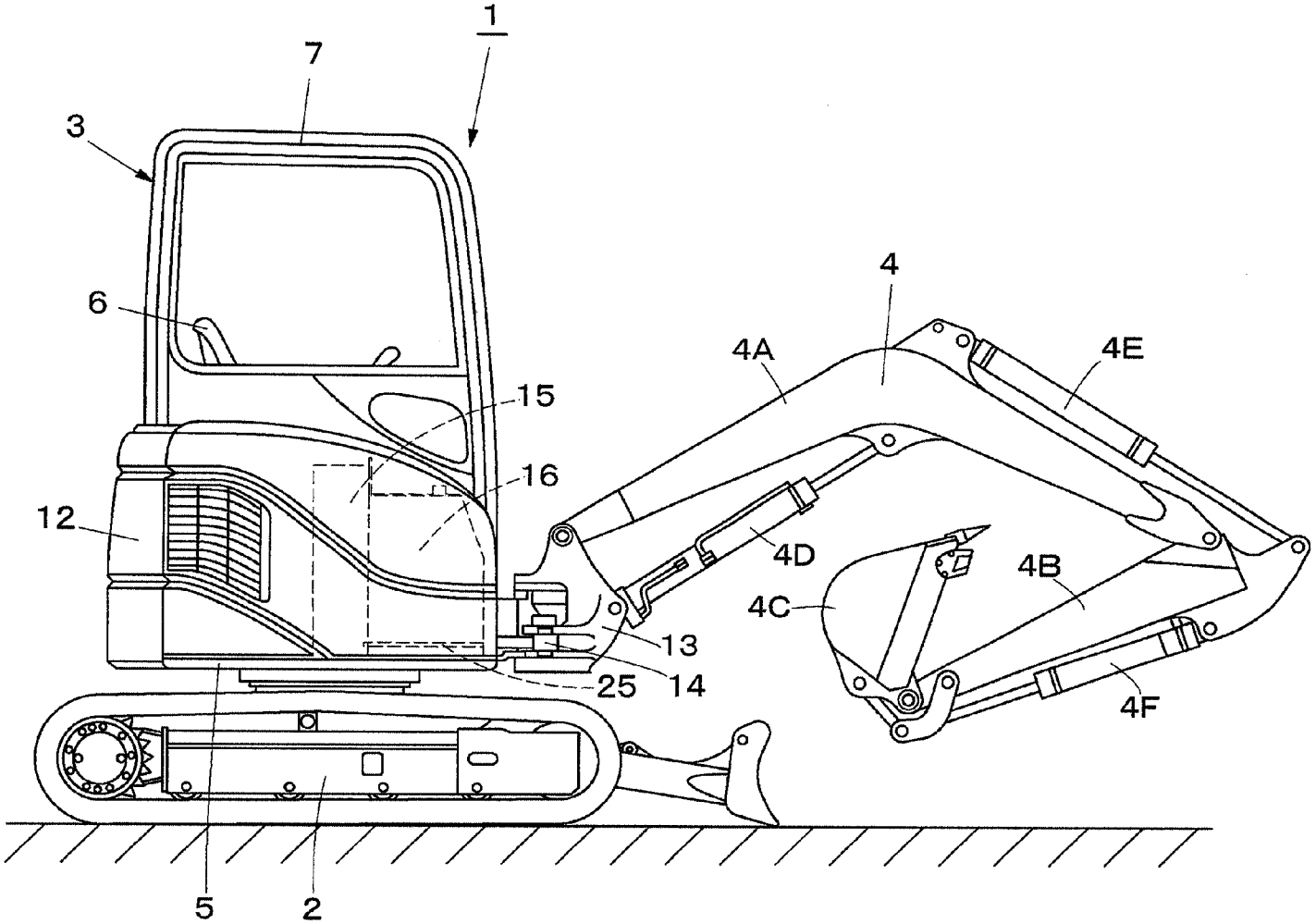
FIG. 1 is a front view illustrating a hydraulic excavator according to an embodiment of the present invention.

An embodiment of a construction machine according to the present invention will be described below in detail by referring to FIGS. 1 to 9 by using a case in which the present invention is applied to a hydraulic excavator as an example.

Designated at 1 is a cab-equipped hydraulic excavator as a typical example of a construction machine. The hydraulic excavator 1 is composed of an automotive crawler-type lower traveling structure 2, and an upper revolving structure 3 rotatably mounted on the lower traveling structure 2. On the front side of the upper revolving structure 3, a working mechanism 4 is provided capable of moving upward/downward.

Subsequently, a configuration of the upper revolving structure 3 will be described. This upper revolving structure 3 is composed of a revolving frame 5, an operator's seat 6, a cab 7, an engine 8, a hydraulic pump 9, a heat exchanger 10, a counterweight 12, an operating oil tank 15, a fuel tank 16 and the like which will be described later.

Figure 2:
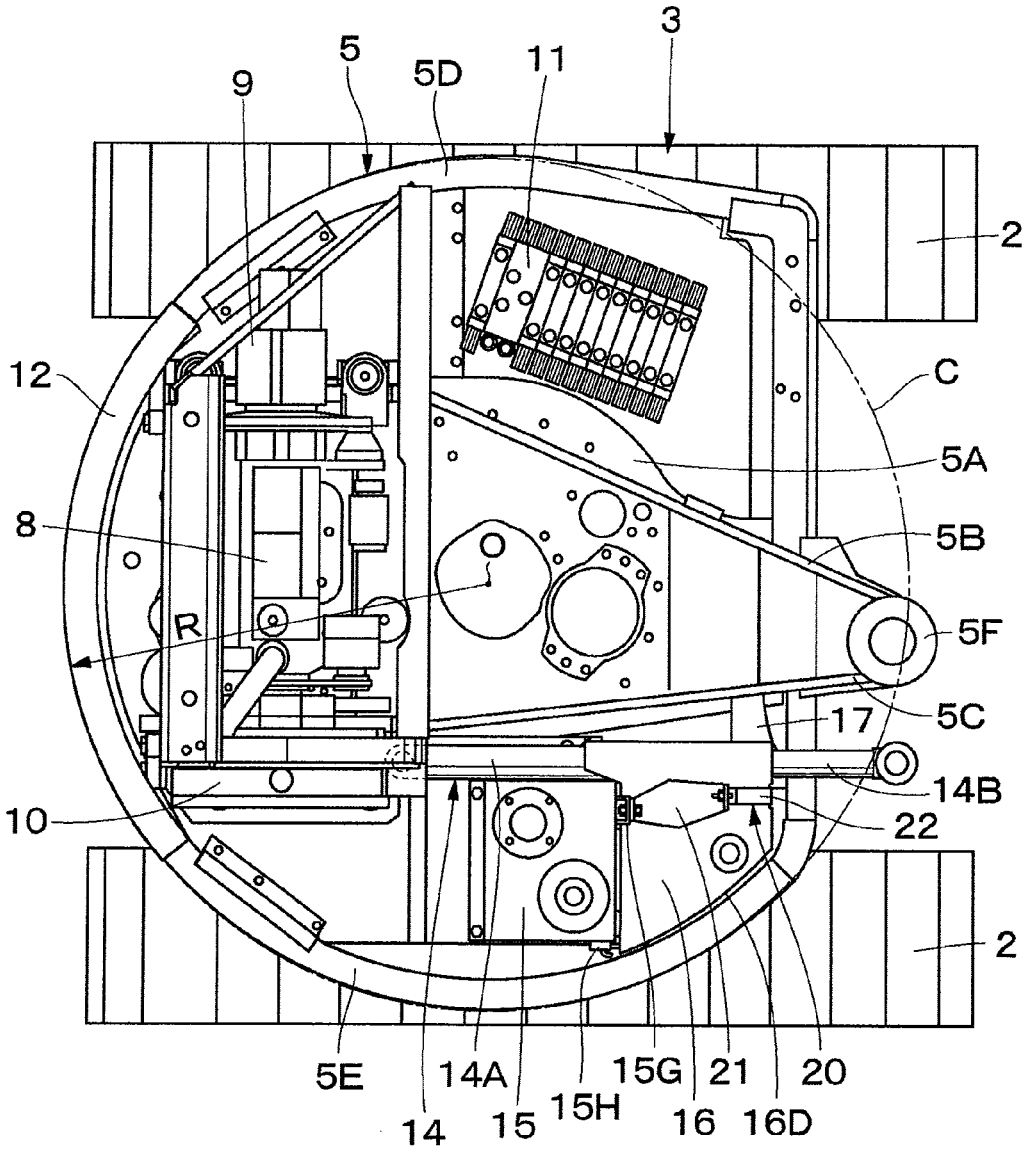
FIG. 2 is a plan view illustrating an upper revolving structure in a state in which an exterior cover, an operator's seat and the like are removed.

Here, the upper revolving structure 3 has a width dimension in the left-right direction substantially equal to a vehicle width of the lower traveling structure 2 as illustrated in FIG. 2 and is formed having a substantially circular shape when seen from above so that, when it is defined that a distance between a revolving center O to the lower traveling structure 2 and a rear surface of the counterweight 12 which will be described later is a revolving radius R, it is substantially contained in a virtual circle C of the revolving radius R around the revolving center O. As a result, the hydraulic excavator 1 is configured as a rear small-revolving type hydraulic excavator in which the rear surface of the counterweight 12 is contained in the vehicle width of the lower traveling structure 2 when the upper revolving structure 3 makes a revolving operation.

Indicated at 4 is the working mechanism provided on the front side of the upper revolving structure 3, capable of moving upward/downward. This working mechanism 4 is composed of a boom 4A mounted on a swing post 13 which will be described later, capable of moving upward/downward, an arm 4B mounted at a distal end part of the boom 4A, capable of moving upward/downward, and a bucket 4C rotabably mounted at a distal end part of the arm 4B. A boom cylinder 4D is provided between the swing post 13 and the boom 4A, an arm cylinder 4E is provided between the boom 4A and the arm 4B, and a bucket cylinder 4F is provided between the arm 4B and the bucket 4C.

Figure 3:
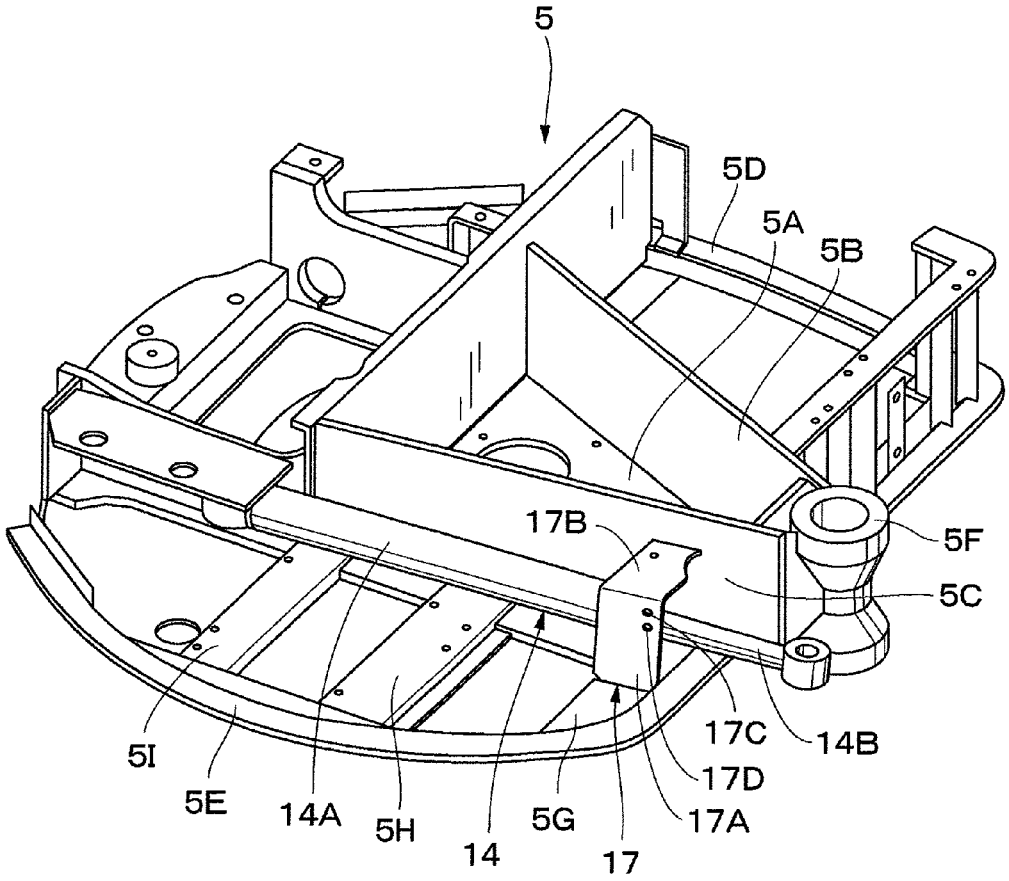
FIG. 3 is a perspective view illustrating a revolving frame as a single body in a state in which a swing cylinder is mounted.

Indicated at 5 is the revolving frame 5 constituting a base of the upper revolving structure 3, and the revolving frame 5 forms a firm support structural body. As illustrated in FIG. 3, this revolving frame 5 is largely constituted by a flat-plate shaped bottom plate 5A extending in a front-rear direction through an intermediate part in the left-right direction, a left vertical plate 5B and a right vertical plate 5C installed upright in a V-shape and separated in the left-right direction on the upper surface side of the bottom plate 5A, a left side frame 5D disposed on the left side of the left vertical plate 5B, and a right side frame 5E disposed on the right side of the right vertical plate 5C. On a front end part of each of the vertical plates 5B and 5C, a supporting bracket 5F is fixedly provided for supporting the swing post 13 which will be described later.

On the other hand, between the bottom plate 5A and the right side frame 5E, three right beams 5G, 5H, and 5I connecting the both to each other are disposed at intervals in the front-rear direction. Between the right beam 5G located on the frontmost part and the right vertical plate 5C, a mounting member 17 which will be described later is provided, and on the other right beams 5H and 5I, the operating oil tank 15, which will be described later, is mounted.

The operator's seat 6 is provided at a position on the left front side in the left-right direction on the revolving frame 5, and the operator's seat 6 is for an operator to be seated on. Moreover, in the periphery of the operator's seat 6, operating devices such as a traveling lever/pedal, an operating lever and the like (not shown) are provided, and the operator's seat 6 and the operating devices are covered by the cab 7.

The engine 8 is mounted on the rear end side of the revolving frame 5, and the engine 8 is located on the front side of the counterweight 12 which will be described later and arranged in a laterally placed state extending in the left-right direction. Here, on the left side of the engine 8, the hydraulic pump 9 driven by the engine 8 is provided, while on the right side of the engine 8, the heat exchanger 10 such as a radiator, an oil cooler or the like is disposed.

A control valve 11 is disposed on the left side on the front part of the revolving frame 5 and on the lower side of the operator's seat 6. This control valve 11 is to control supply/discharge of a pressurized oil from the hydraulic pump 9 with respect to the hydraulic actuator mounted on the hydraulic excavator 1 in accordance with an operation of the various operating devices (not shown).

The counterweight 12 is located on the rear side of the engine 8 and mounted on a rear end portion of the revolving frame 5 (see FIG. 1). This counterweight 12 is to keep balance in weight with the working mechanism 4 and as illustrated in FIG. 2, is arranged on the rear side of the engine 8 and has a projecting curved shape extending in an arc shape in the left-right direction so as to be contained in the revolving radius R of the upper revolving structure 3.

The swing post 13 is provided on the supporting bracket 5F of the revolving frame 5 swingably, and the swing post 13 is integrally formed by casting or the like, for example, and pin-connected to the supporting bracket 5F swingably in the left-right direction. This swing post 13 is to support the working mechanism 4 swingably in the left-right direction, and the base end portion of the boom 4A and the bottom side of the boom cylinder 4D are mounted on the swing post 13.

Designated at 14 is the swing cylinder provided between the revolving frame 5 and the swing post 13, and the swing cylinder 14 is arranged on the outside (right side) in the left-right direction from the right vertical plate 5C of the revolving frame 5. This swing cylinder 14 is composed of a tube 14A, a piston (not shown) slidably provided in the tube 14A, and a rod 14B having the base end side mounted on the piston and the distal end side protruding to the outside of the tube 14A. As illustrated in FIG. 2, the swing cylinder 14 extends in the front-rear direction along the outer side surface of the right vertical plate 5C, the bottom side of the tube 14A is rotatably pin-connected to the revolving frame 5, and the distal end side of the rod 14B is rotatably pin-connected to the right side surface side of the swing post 13. Therefore, by extending/contracting the swing cylinder 14, the swing post 13 is configured to swing in the left-right direction around a pin connection portion with the supporting bracket 5F.

Subsequently, the operating oil tank 15 and the fuel tank 16 provided on the revolving frame 5 of the upper revolving structure 3 will be described.

Designated at 15 is the operating oil tank located in the vicinity of the swing cylinder 14 and on the front side of the engine 8 and mounted on the revolving frame 5. Specifically, the operating oil tank 15 is mounted between the right beams 5H and 5I of the revolving frame 5. The operating oil tank 15 is to store an operating oil supplied to the hydraulic actuator such as each of the cylinders 4D, 4E and 4F of the working mechanism 4, the swing cylinder 14, a revolving motor, a traveling motor (neither of them is shown) and the like from the hydraulic pump 9. Here, the operating oil tank 15 has a pressure acted inside so that the operating oil can be supplied efficiently to the hydraulic pump 9. Thus, the operating oil tank 15 is formed having a large strength by using a steel plate or the like, for example.

That is, as illustrated in FIGS. 4 to 8, the operating oil tank 15 is formed as a cuboid which is flat in the front-rear direction and lengthy in the vertical direction by a front surface plate 15A, a rear surface plate 15B, a left side surface plate 15C, a right side surface plate 15D, an upper surface plate 15E, and a bottom surface plate 15F. In this case, a height dimension of the operating oil tank 15 is set larger than the fuel tank 16 which will be described later.

Here, on an upper part position of the operating oil tank 15, that is, on the upper end side of the front surface plate 15A, a plate-shaped screw seat 15G is fastened at a position higher than an upper surface portion 16E of the fuel tank 16 which will be described later by using means such as welding. This screw seat 15G is to mount a connecting member 21 which will be described later. On a lower end portion of the right side surface plate 15D of the operating oil tank 15, a locking member 15H formed of a plate body bent having a U-shaped section is fastened by using means such as welding. This locking member 15H is to lock the rear end side of a lateral restraining element 25 which will be described later.

Designated at 16 is the fuel tank mounted on the revolving frame 5 adjacently to the front side of the operating oil tank 15. The fuel tank 16 is arranged in the front-rear direction along the swing cylinder 14 together with the operating oil tank 15, and a fuel to be supplied to the engine 8 is stored in the fuel tank 16. Here, the fuel tank 16 is formed as a container having an irregular shape using a resin material, for example. That is, the fuel tank 16 is composed of a front surface portion 16A, a rear surface portion 16B, a left side surface portion 16C, a right side surface portion 16D, an upper surface portion 16E, a deep bottom portion 16F, a shallow bottom portion 16G, and a stepped surface portion 16H and is mounted on the right beams 5G and 5H of the revolving frame 5 and the mounting member 17 which will be described later.

Figure 4:
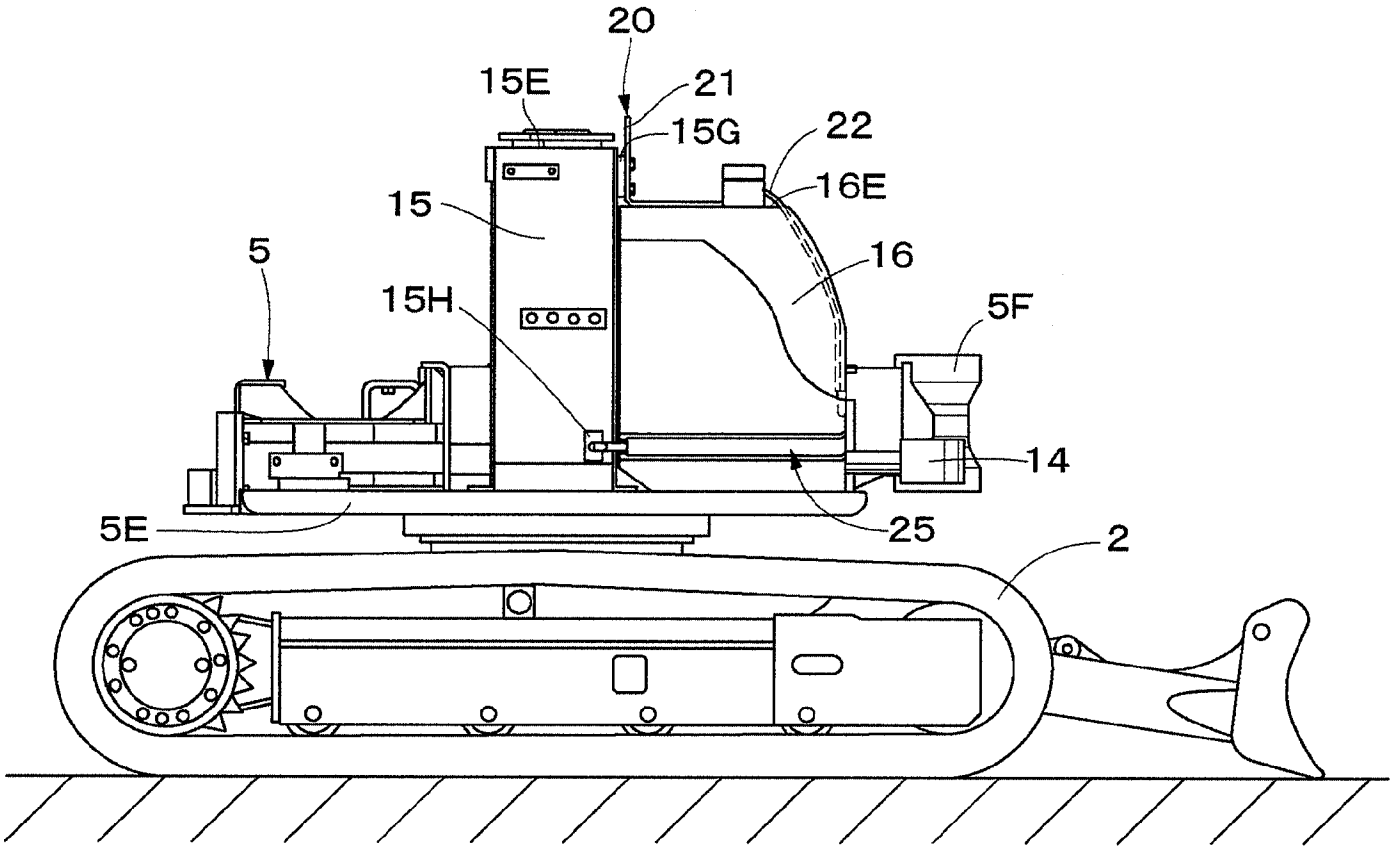
FIG. 4 is a front view illustrating a state in which an operating oil tank, a fuel tank, the swing cylinder, a vertical restraining element, and a lateral restraining element are mounted on the upper revolving structure.
Figure 5:
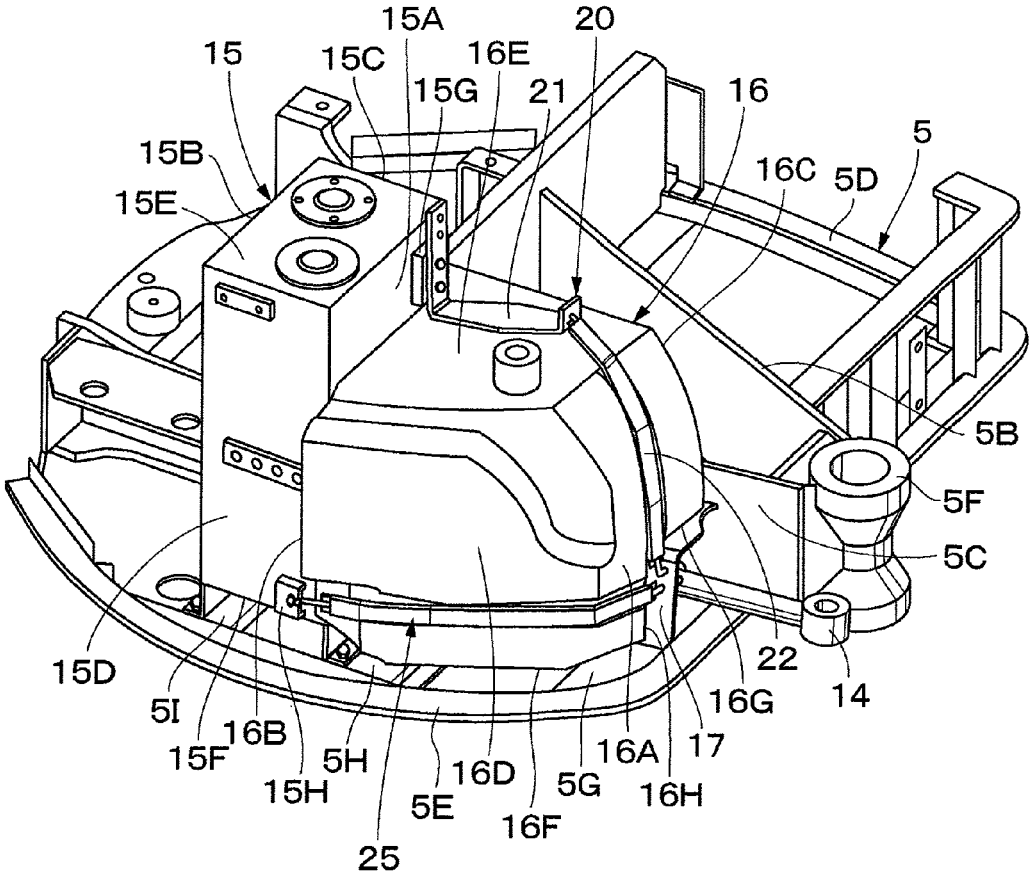
FIG. 5 is an appearance perspective view illustrating a state in which the operating oil tank, the fuel tank, the swing cylinder, the vertical restraining element, and the lateral restraining element are mounted on the revolving frame.
Figure 6:
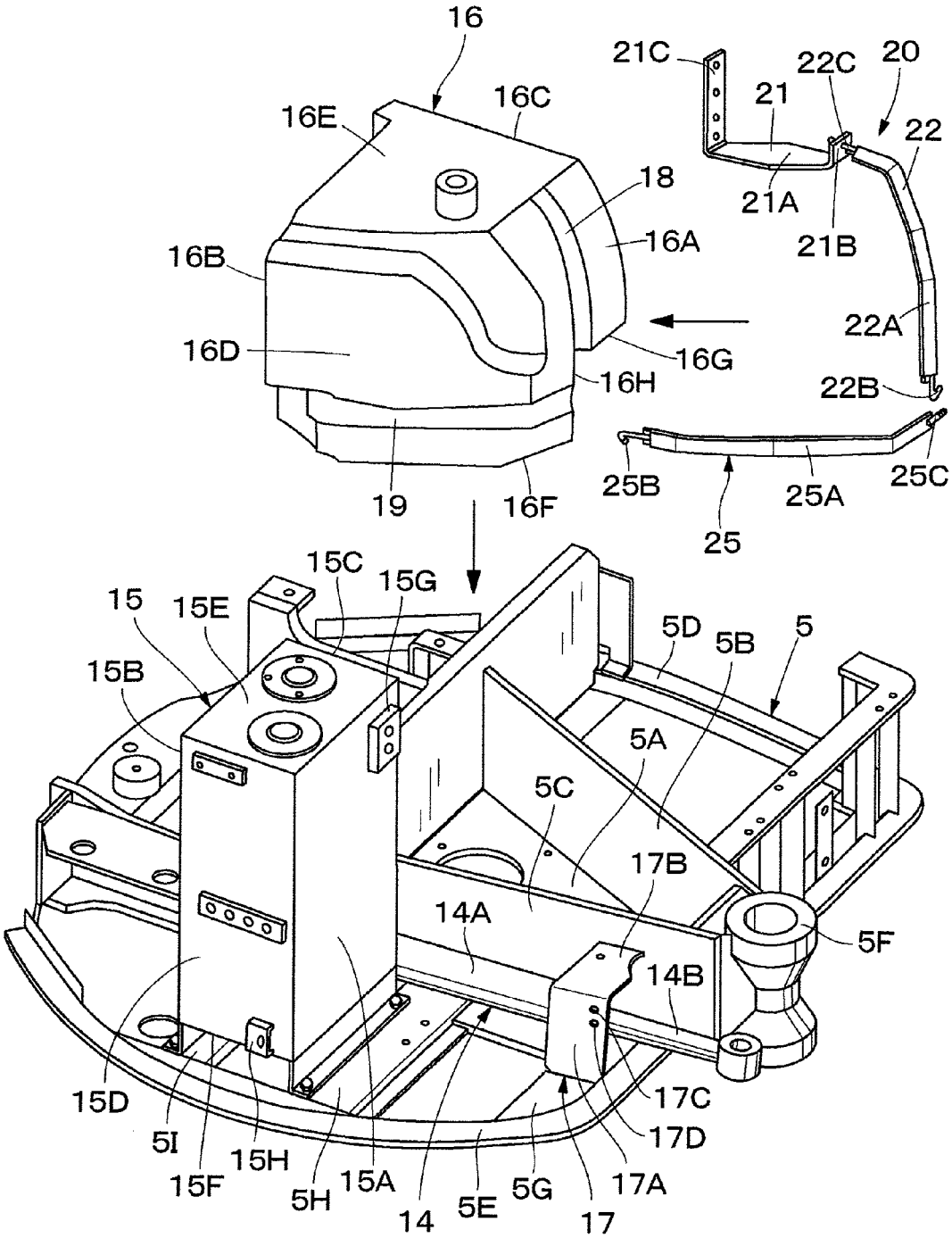
FIG. 6 is an exploded perspective view illustrating a state in which only the operating oil tank and the swing cylinder are mounted on the revolving frame, and the fuel tank, the vertical restraining element, and the lateral restraining element are removed.

Here, as illustrated in FIG. 2, the right side surface portion 16D which is the outside in the left-right direction of the fuel tank 16 is formed having an arc shape when seen from above so as to be contained in the virtual circle C of the revolving radius R around the revolving center O of the upper revolving structure 3. Moreover, as illustrated in FIGS. 4 and 5, the upper surface portion 16E of the fuel tank 16 is formed lower than the upper surface plate 15E of the operating oil tank 15 in a state in which the operating oil tank 15 and the fuel tank 16 are mounted on the revolving frame 5. In this case, the upper surface portion 16E of the fuel tank 16 is arranged on the lower side than the screw seat 15G provided on the front surface plate 15A of the operating oil tank 15.

On the other hand, as illustrated in FIGS. 6 to 9, the right side portion of the bottom surface of the fuel tank 16 becomes the deep bottom portion 16F, and the left side portion becomes the shallow bottom portion 16G. Between the left end side of the deep bottom portion 16F and the right end side of the shallow bottom portion 16G, the stepped surface portion 16H is provided. A height dimension of the stepped surface portion 16H is formed substantially equal to the height dimension of a vertical plate portion 17A of the mounting member 17 which will be described later.

As described above, the bottom surface of the fuel tank 16 is formed having a stepped shape by the deep bottom portion 16F and the shallow bottom portion 16G, the deep bottom portion 16F is placed on the right beams 5G and 5H of the revolving frame 5, and the shallow bottom portion 16G is placed on a lateral plate portion 17B of the mounting member 17. The stepped surface portion 16H is in contact with the vertical plate portion 17A of the mounting member 17. Therefore, the fuel tank 16 is mounted on the revolving frame 5 by effectively using a space above the swing cylinder 14 by arranging the shallow bottom portion 16G on the swing cylinder 14.

At a center part in the left-right direction of the front surface portion 16A of the fuel tank 16, a vertical groove portion 18 is provided. This vertical groove portion 18 extends in the vertical direction between the upper surface portion 16E and the shallow bottom portion 16G and positions a belt portion 22A of a belt member 22 which will be described later. On the other hand, on the lower end side of the right side surface portion 16D of the fuel tank 16, a lateral groove portion 19 is provided. This lateral groove portion 19 extends in the front-rear direction and the left-right direction (horizontal direction) between the rear surface portion 16B and the stepped surface portion 16H and positions a belt member 25A of the lateral restraining element 25 which will be described later.

Subsequently, designated at 17 is the mounting member provided on the right side on the front part of the revolving frame 5, and this mounting member 17 is positioned in the vicinity of the supporting bracket 5F and is arranged between the right beam 5G and the right vertical plate 5C of the revolving frame 5. Therefore, the mounting member 17 is located on the lower side of the fuel tank 16 and provided across a part of the swing cylinder 14 (on the rod 14B side).

Here, the mounting member 17 is composed of the vertical plate portion 17A rising upward from the right beam 5G of the revolving frame 5 and the lateral plate portion 17B extending in the horizontal direction from the upper end of the vertical plate portion 17A to the right vertical plate 5C side through the upper part of the swing cylinder 14. That is, the mounting member 17 is formed having an inverted L-shape by the vertical plate portion 17A and the lateral plate portion 17B, the lower end portion of the vertical plate portion 17A is fastened to the right beam 5G of the revolving frame 5, and the left end portion of the lateral plate portion 17B is fastened to the right vertical plate 5C. Therefore, the mounting member 17 is provided across so as to surround the rod 14B of the swing cylinder 14. As a result, when the swing cylinder 14 swings in the left-right direction around a pin connection portion (not shown) of the revolving frame 5, a moving path of the rod 14B is ensured by the mounting member 17.

On the upper front end side of the vertical plate portion 17A, a locking hole 17C for locking the lower end side of a vertical restraining element 20 which will be described later is provided. On the lower side of the locking hole 17C, a screw-portion insertion hole 17D through which a male screw portion 25C of the lateral restraining element 25 which will be described later is inserted is provided. In this case, the locking hole 17C and the screw-portion insertion hole 17D are located on the front side from a bottom portion of the vertical groove portion 18 provided on the front surface portion 16A of the fuel tank 16 and a bottom portion of the lateral groove portion 19 when the shallow bottom portion 16G of the fuel tank 16 is placed on the mounting member 17.

Subsequently, the vertical restraining element 20 and the lateral restraining element 25 used for fixing the fuel tank 16 will be described by referring to FIGS. 5 to 8.

Designated at 20 is the vertical restraining element provided between the upper part position of the operating oil tank 15 and the mounting member 17. The vertical restraining element 20 is to regulate movement in the front-rear direction and the vertical direction of the fuel tank 16. This vertical restraining element 20 is constituted as an integral article by connecting the connecting member 21 and the belt member 22 which will be described later.

Figure 8:
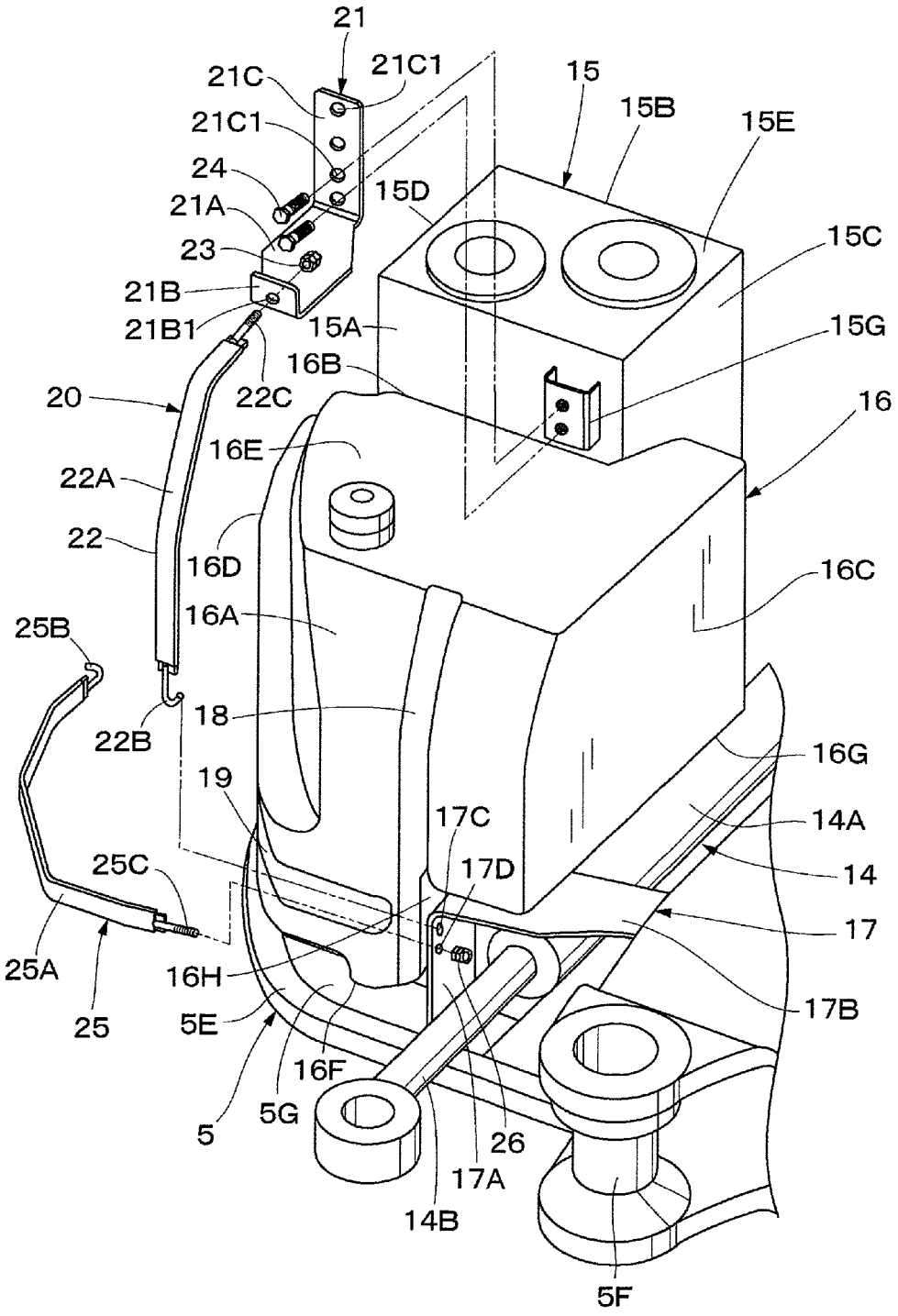
FIG. 8 is an exploded perspective view of an essential part in an enlarged manner illustrating a state in which the vertical restraining element and the lateral restraining element are removed from the fuel tank.
Figure 9:
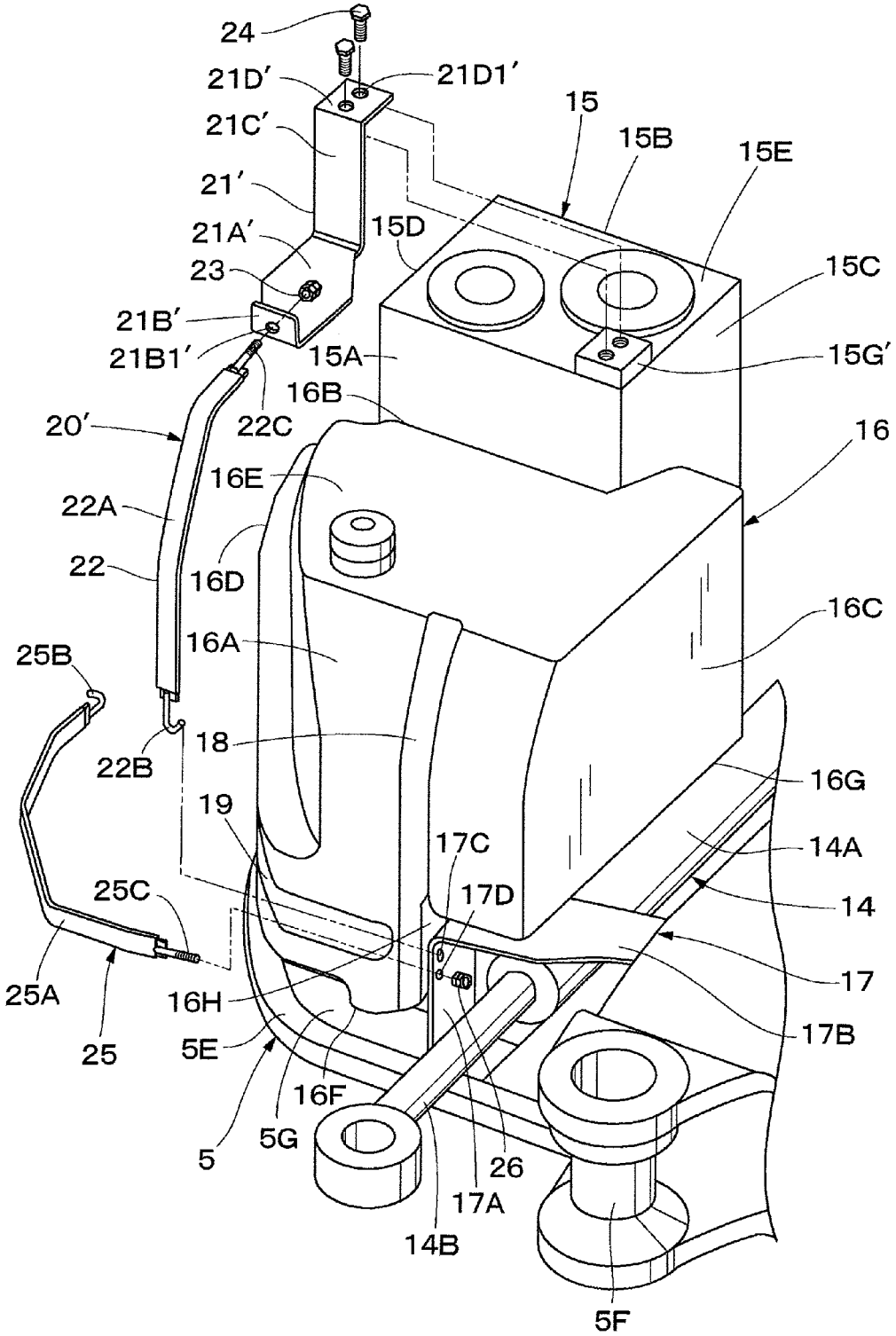
FIG. 9 is an exploded perspective view similar to FIG. 8 illustrating a modification of the vertical restraining element.

The connecting member 21 is mounted on the front surface plate 15A of the operating oil tank 15, and the connecting member 21 is formed by bending a plate-shaped body made of metal, for example. This connecting member 21 is located on the upper side of the upper surface portion 16E of the fuel tank 16 and mounted on the screw seat 15G of the operating oil tank 15. Here, the connecting member 21 is formed of a flat-plate shaped flat plate portion 21A extending in the front-rear direction, a front plate portion 21B bent upward from the front end side of the flat plate portion 21A, and a rear plate portion 21C bent upward from the rear end side of the flat plate portion 21A, and the connecting member 21 generally has an L-shape. As illustrated in FIG. 8, one screw-portion insertion hole 21B1 through which a male screw portion 22C of the belt member 22 which will be described later is inserted is provided in the front plate portion 21B, and a plurality of bolt insertion holes 21C1 through which a bolt 24 which will be described later is inserted is provided side by side in the vertical direction in the rear plate portion 21C.

The belt member 22 is formed of a lengthy plate body made of metal or resin, for example, and the belt member 22 has the upper end side connected to the connecting member 21 and the lower end side mounted on the mounting member 17. This belt member 22 is to regulate movement of the fuel tank 16 in the front-rear direction by being brought into contact with the front surface portion 16A of the fuel tank 16. Here, the belt member 22 is composed of a belt portion 22A extending in the vertical direction along the vertical groove portion 18 formed in the front surface portion 16A of the fuel tank 16, a locking hook 22B provided by being fastened to the lower end side of the belt portion 22A and having a lower end portion bent in a J-shape, and the male screw portion 22C provided by being fastened to the upper end side of the belt portion 22A.

As illustrated in FIG. 8, the male screw portion 22C of the belt member 22 is inserted through the screw-portion insertion hole 21B1 provided in the front plate portion 21B of the connecting member 21, and a nut 23 is screwed with the male screw portion 22C. Thereby, the vertical restraining element 20 in which the connecting member 21 and the belt member 22 are integrated is formed. Through the bolt insertion hole 21C1 provided in the rear plate portion 21C of the connecting member 21, the bolt 24 is inserted, and this bolt 24 is screwed with the screw seat 15G of the operating oil tank 15. As a result, the rear plate portion 21C of the connecting member 21 is fixed to the upper part position of the front surface plate 15A of the operating oil tank 15, and the flat plate portion 21A of the connecting member 21 can be brought into contact with the upper surface portion 16E of the fuel tank 16.

In this state, the locking hook 22B of the belt member 22 is locked by the locking hole 17C provided in the vertical plate portion 17A of the mounting member 17. On the other hand, the belt portion 22A of the belt member 22 is arranged along the vertical groove portion 18 of the fuel tank 16 and then, the nut 23 screwed with the male screw portion 22C of the belt member 22 is tightened. As a result, the connecting member 21 and the belt member 22 are integrated, and the flat plate portion 21A of the connecting member 21 can be brought into contact with the upper surface portion 16E of the fuel tank 16. Moreover, the belt portion 22A of the belt member 22 can be brought into contact with the front surface portion 16A of the fuel tank 16 with an appropriate tightening force. As described above, by pressing the fuel tank 16 to the revolving frame 5 and the operating oil tank 15, the movement of the fuel tank 16 in the vertical direction and the front-rear direction can be regulated.

The lateral restraining element 25 is formed of a lengthy plate body made of metal or resin, for example, and the lateral restraining element 25 is provided between the right side surface plate 15D which is on the outside in the left-right direction of the operating oil tank 15 and the mounting member 17. This lateral restraining element 25 is to regulate the movement of the fuel tank 16 in the left-right direction by being brought into contact with the right side surface portion 16D of the fuel tank 16. Here, the lateral restraining element 25 is composed of the belt member 25A extending in the left-right direction and the front-rear direction (horizontal direction) along the lateral groove portion 19 formed in the front surface portion 16A and the right side surface portion 16D of the fuel tank 16, a locking hook 25B provided by being fastened to the rear end side of the belt member 25A and having the rear end portion bent in the J-shape, and the male screw portion 25C provided by being fastened to the front end side of the belt member 25A.

Figure 7:
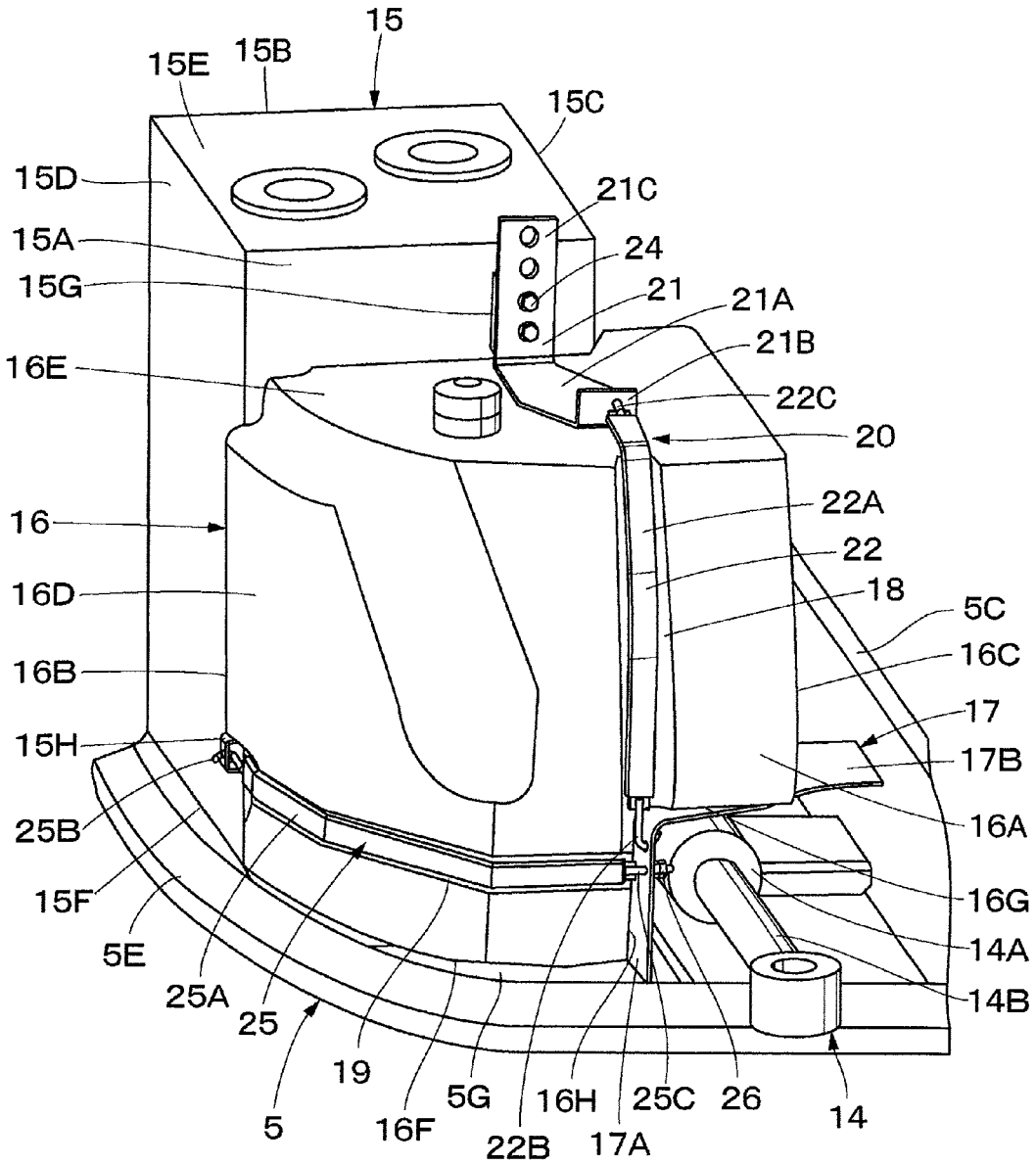
FIG. 7 is a perspective view of an essential part in an enlarged manner illustrating a state in which the fuel tank mounted on the revolving frame is restrained by the vertical restraining element and the lateral restraining element.

As illustrated in FIG. 7, the locking hook 25B of the lateral restraining element 25 is locked by the locking member 15H provided on the lower end side of the right side surface plate 15D of the operating oil tank 15, and the belt member 25A is arranged along the lateral groove portion 19 of the fuel tank 16. As illustrated in FIG. 8, the male screw portion 25C of the lateral restraining element 25 is inserted through the screw-portion insertion hole 17D provided in the vertical plate portion 17A of the mounting member 17, and a nut 26 is tightened to the male screw portion 25C. As a result, the belt member 25A of the lateral restraining element 25 can be brought into contact with the right side surface portion 16D of the fuel tank 16 by using an appropriate tightening force. As described above, by pressing the fuel tank 16 to the vertical plate portion 17A of the mounting member 17, the movement of the fuel tank 16 in the left-right direction and the front-rear direction can be regulated.

The hydraulic excavator 1 according to this embodiment has the configuration as above, and next, a work of mounting the fuel tank 16 used in this embodiment will be described.

First, the fuel tank 16 is placed on the revolving frame 5 at a position on the front side of the operating oil tank 15. Here, since the bottom surface of the fuel tank 16 has a stepped bottom surface shape by the deep bottom portion 16F and the shallow bottom portion 16G, the deep bottom portion 16F is placed on the right beams 5G and 5H of the revolving frame 5. On the other hand, the shallow bottom portion 16G is placed on the lateral plate portion 17B of the mounting member 17 provided between the right beam 5G and the right vertical plate 5C of the revolving frame 5. In this case, in the lower-side space of the lateral plate portion 17B, the swing cylinder 14 is disposed. Therefore, by effectively using the upper-side space of the swing cylinder 14, the fuel tank 16 having a large capacity can be arranged on the narrow revolving frame 5.

Subsequently, the fuel tank 16 is fixed by using the vertical restraining element 20 and the lateral restraining element 25. First, the male screw portion 22C of the belt member 22 is inserted through the screw-portion insertion hole 21B1 provided in the front plate portion 21B of the connecting member 21. In this state, by screwing the nut 23 with the male screw portion 22C, the connecting member 21 and the belt member 22 are connected so as to form the vertical restraining element 20. On the other hand, the bolt 24 is inserted through the bolt insertion hole 21C1 provided in the rear plate portion 21C of the connecting member 21, and this bolt 24 is screwed in the screw seat 15G of the operating oil tank 15. As a result, the rear plate portion 21C of the connecting member 21 is fixed to the front surface plate 15A of the operating oil tank 15, and the flat plate portion 21A of the connecting member 21 can be brought into contact with the upper surface portion 16E of the fuel tank 16.

In this state, the locking hook 22B of the belt member 22 is locked by the locking hole 17C provided in the vertical plate portion 17A of the mounting member 17. The belt portion 22A of the belt member 22 is arranged along the vertical groove portion 18 of the fuel tank 16, and the nut 23 screwed with the male screw portion 22C of the belt member 22 is tightened. As a result, the flat plate portion 21A of the connecting member 21 is brought into contact with the upper surface portion 16E of the fuel tank 16 and at the same time, the belt portion 22A of the belt member 22 can be brought into contact with the front surface portion 16A of the fuel tank 16 with an appropriate tightening force. Therefore, by pressing the fuel tank 16 to the revolving frame 5 and the operating oil tank 15, the movement of the fuel tank 16 in the vertical direction and the front-rear direction can be regulated.

Subsequently, the locking hook 25B of the lateral restraining element 25 is locked by the locking member 15H provided on the lower end side of the right side surface plate 15D of the operating oil tank 15, and the belt member 25A of the lateral restraining element 25 is arranged along the lateral groove portion 19 of the fuel tank 16. On the other hand, the male screw portion 25C of the lateral restraining element 25 is inserted through the screw-portion insertion hole 17D provided in the vertical plate portion 17A of the mounting member 17, and the nut 26 screwed with the male screw portion 25C is tightened. As a result, the belt member 25A of the lateral restraining element 25 can be brought into contact with the right side surface portion 16D of the fuel tank 16 with an appropriate tightening force. Therefore, by pressing the fuel tank 16 to the vertical plate portion 17A of the mounting member 17, the movement of the fuel tank 16 in the left-right direction and the front-rear direction can be regulated.

As described above, according to this embodiment, the fuel tank 16 can be reliably fixed in the two direction, that is, the horizontal direction (the front-rear direction and the left-right direction) and the perpendicular direction (the vertical direction) (or more specifically, three axial directions of the front-rear direction, the left-right direction, and the vertical direction) by the vertical restraining element 20 and the lateral restraining element 25. Therefore, dislocation of the fuel tank 16 with respect to the revolving frame 5 caused by vibration during traveling or working of the hydraulic excavator 1 can be reliably suppressed, and dislocation of the fuel tank 16 and contact with the peripheral mounted devices can be prevented. Therefore, a clearance between the fuel tank 16 and the peripheral mounted devices can be set smaller, and the capacity of the fuel tank 16 can be ensured larger by that portion.

In this embodiment, the locking hook 22B provided on the one end side of the vertical restraining element 20 is locked by the locking hole 17C of the mounting member 17, and the male screw portion 22C provided on the other end side is fixed to the front plate portion 21B of the connecting member 21. On the other hand, the locking hook 25B provided on the one end side of the lateral restraining element 25 is locked by the locking member 15H of the operating oil tank 15, and the male screw portion 25C provided on the other end side is fixed to the vertical plate portion 17A of the mounting member 17. As a result, during maintenance of the swing cylinder 14, in a case where the fuel tank 16 is to be removed from the revolving frame 5, the vertical restraining element 20 and the lateral restraining element 25 can be removed easily, and a mounting/removing work of the fuel tank 16 can be performed rapidly and easily.

Moreover, according to this embodiment, the locking hole 17C and the screw-portion insertion hole 17D provided in the vertical plate portion 17A of the mounting member 17 are provided so as to be located on the front side from the bottom portion of the vertical groove portion 18 provided in the front surface portion 16A of the fuel tank 16 and the bottom portion of the lateral groove portion 19. As a result, the locking hole 17C and the screw-portion insertion hole 17D of the lateral restraining element 25 are provided in the vertical plate portion 17A of the mounting member 17, the locking hook 22B of the vertical restraining element 20 is locked by the locking hole 17C, and the male screw portion 25C of the lateral restraining element 25 can be inserted through the screw-portion insertion hole 17D. As a result, by fixing the two restraining elements (the vertical restraining element 20 and the lateral restraining element 25) to the mounting member 17 which is the same member, the number of components can be reduced, and a manufacturing cost can be lowered.

In this embodiment, the case in which screw seat 15G is provided at the front surface upper-part position of the operating oil tank 15, that is, on the upper end side of the front surface plate 15A, and the connecting member 21 of the vertical restraining element 20 is mounted at the front surface upper-part position of the operating oil tank 15 through the screw seat 15G is exemplified. However, the present invention is not limited to the same, and may be configured such that as in a modification illustrated in FIG. 9, for example, a connecting member 21' of a vertical restraining element 20' is mounted at the upper surface front-part position of the operating oil tank 15.

In this case, a screw seat 15G' is fixed on the front end side of the upper surface plate 15E of the operating oil tank 15. On the other hand, the vertical restraining element 20' is composed of the connecting member 21' and the belt member 22. The connecting member 21' is composed of a flat plate portion 21A' extending in the front-rear direction, a front plate portion 21B' bent upward from the front end side of the flat plate portion 21A', a rear plate portion 21C' bent upward from the rear end side of the flat plate portion 21A', and a rear flat plate portion 21D' bent rearward from the upper end side of the rear plate portion 21C'. In the front plate portion 21B', one screw-portion insertion hole 21B1' through which the male screw portion 22C of the belt member 22 is inserted is provided, and in the rear flat plate portion 21D', a plurality of bolt insertion holes 21D1' through which the bolt 24 is inserted are provided.

Therefore, by inserting the bolt 24 through the bolt insertion hole 21D1' provided in the rear flat plate portion 21D' of the connecting member 21' and by screwing this bolt 24 in the screw seat 15G' of the operating oil tank 15, the connecting member 21' of the vertical restraining element 20' can be mounted at the upper surface front-part position of the operating oil tank 15. By configured as above, too, the same effects as those in this embodiment can be obtained.

In this embodiment, the case in which the locking hook 22B provided on the lower end side of the vertical restraining element 20 is locked by the locking hole 17C provided in the vertical plate portion 17A of the mounting member 17, and the male screw portion 22C provided on the upper end side is fixed to the front plate portion 21B of the connecting member 21 is exemplified. However, the present invention is not limited to the same, and it may be so configured that the locking hook 22B is locked by the connecting member 21, and the male screw portion 22C is fixed to the mounting member 17. Similarly, it may be so configured that the locking hook 25B of the lateral restraining element 25 is locked by the mounting member 17, and the male screw portion 25C is fixed to the right side surface plate 15D of the operating oil tank 15.

In this embodiment, on the basis of the positions of the left and right vertical plates 5B and 5C constituting the revolving frame 5 and the supporting bracket 5F, the hydraulic excavator 1 in which the cab 7 is mounted on the left side, while the swing cylinder 14, the operating oil tank 15, and the fuel tank 16 are mounted on the right side is exemplified. However, on the contrary, on the basis of the position of the left and right vertical plates 5B and 5C and the supporting bracket 5F, the present invention can be applied also to a hydraulic excavator in which the swing cylinder 14, the operating oil tank 15, and the fuel tank 16 are mounted on the left side, while the cab 7 is mounted on the right side.

Moreover, in this embodiment, the case in which the present invention is applied to the cab-type hydraulic excavator 1 in which the periphery of the operator's seat 6 is covered by the cab 7 is explained as an example, but instead of this, the present invention may be applied also to a canopy-type hydraulic excavator in which the upper side of the operator's seat 6 is covered by a canopy.

DESCRIPTION OF REFERENCE NUMERALS

1: Hydraulic excavator (Construction machine)
2: Lower traveling structure
3: Upper revolving structure
4: Working mechanism
5: Revolving frame
5A: Bottom plate
5B: Left vertical plate
5C: Right vertical plate
5F: Supporting bracket
8: Engine
9: Hydraulic pump
12: Counterweight
13: Swing post
14: Swing cylinder
15: Operating oil tank
15D: Right side surface plate
15E: Upper surface plate
16: Fuel tank
16A: Front surface portion
16D: Right side surface portion
16E: Upper surface portion
16F: Deep bottom portion
16G: Shallow bottom portion
17: Mounting member
17A: Vertical plate portion
17B: Lateral plate portion
20, 20': Vertical restraining element
21, 21': Connecting member
22: Belt member
22A: Belt portion
22B: Locking hook
22C: Male screw portion
23, 26: Nut
24: Bolt
25: Lateral restraining element
25A: Belt member
25B: Locking hook
25C: Male screw portion

The invention claimed is:

1. A construction machine, comprising:

a lower traveling structure, an upper revolving structure rotatably mounted on said lower traveling structure, a working mechanism provided on the front side of said upper revolving structure capable of moving upward/downward, and a counterweight provided on the rear side of said upper revolving structure in order to keep balance with said working mechanism, wherein said upper revolving structure includes:

a revolving frame forming a support structural body and on which a supporting bracket is provided on a front end;

an engine located on the front side of said counterweight and mounted on said revolving frame;

a swing post provided on said supporting bracket of said revolving frame and supporting said working mechanism swingably in the left-right direction;

a swing cylinder provided between said swing post and said revolving frame and swinging said swing post in the left-right direction;

an operating oil tank located in the vicinity of said swing cylinder and on the front side of said engine and provided on said revolving frame and storing an operating oil to be supplied to a hydraulic actuator; and a fuel tank located on the front side of said operating oil tank and provided on said revolving frame and storing a fuel to be supplied to said engine, wherein a mounting member is provided on said revolving frame across a part of said swing cylinder and located on the lower side of said fuel tank;

a vertical restraining element for restraining said fuel tank in the front-rear direction and the vertical direction is detachably provided between an upper-part position of said operating oil tank and said mounting member, a lateral restraining element for restraining said fuel tank in the left-right direction is detachably provided between an outer surface portion of a side of said operating oil tank in the left-right direction, and said mounting member, and a lower end side of said vertical restraining element and a front end side of said lateral restraining element are attached to said mounting member.

2. The construction machine according to claim 1, wherein said upper revolving structure is configured such that said revolving frame is formed of a bottom plate, a left vertical extending plate and a right vertical extending plate, said supporting bracket supporting said swing post is provided on front ends of said left vertical extending plate and said right vertical extending plate, said swing cylinder is disposed outside in the left-right direction of one of said left vertical extending plate and said right vertical extending plate, and said operating oil tank and said fuel tank are arranged in the front-rear direction along said swing cylinder.

3. The construction machine according to claim 1, wherein an upper surface of said fuel tank is formed lower than an upper surface of said operating oil tank, said vertical restraining element includes a connecting member located on the upper side from said upper surface of said fuel tank and mounted to said operating oil tank and a first belt member having the upper end side connected to said connecting member and the lower end side mounted on said mounting member and brought into contact with a front surface of said fuel tank, and said lateral restraining element includes a second belt member having the front end side mounted on said mounting member and the rear end side mounted on the outer surface portion of said side of said operating oil tank and brought into contact with an outer surface portion of said fuel tank in the left-right direction.

4. The construction machine according to claim 3, wherein said connecting member mounted to said operating oil tank is disposed at one of an upper-part position on said front surface and a front portion position on said upper surface of said operating oil tank.

5. The construction machine according to claim 1, wherein a bottom surface of said fuel tank has a stepped bottom surface shape having a deep bottom portion outside and a shallow bottom portion inside in the left-right direction;

said mounting member has an inverted L-shape formed of a vertical plate portion and a lateral plate portion connected to an upper end of said vertical plate portion in the left-right direction surrounding said swing cylinder, and said shallow bottom portion of said fuel tank is disposed on said lateral plate portion of said mounting member, and the lower end side of said vertical restraining element and the front end side of said lateral restraining element are mounted on said vertical plate portion.

6. The construction machine according to claim 1, wherein said upper revolving structure has a revolving radius, which is a distance between a center (O) of said upper revolving structure and a rear surface of said counterweight, wherein an outer surface of a side of said fuel tank in the left-right direction has an arc shape and said outer surface of said side having said arc shape is within said revolving radius (R), and wherein a distance of a diameter of a circle C having said revolving radius (R) is less than a maximum width of said lower travelling structure.

* * * * *